US006280368B1

(12) United States Patent
Liao

(10) Patent No.: US 6,280,368 B1
(45) Date of Patent: Aug. 28, 2001

(54) BODY CONTOURING DEVICE

(76) Inventor: Chih-Hui Liao, PO Box 82-144, Taipei (TW)

( * ) Notice: Subject to any disclaimer, the term of this patent is extended or adjusted under 35 U.S.C. 154(b) by 0 days.

(21) Appl. No.: 09/575,799

(22) Filed: May 22, 2000

(51) Int. Cl.[7] ..... A63B 23/08; A63B 23/10

(52) U.S. Cl. ..... 482/146; 482/147

(58) Field of Search ..... 482/146, 147, 482/148, 51, 71, 79, 54

(56) References Cited

U.S. PATENT DOCUMENTS 3,911,907 * 10/1975 Smith ..... 482/146
5,096,188 * 3/1992 Shen ..... 482/70
5,695,439 * 12/1997 Lin ..... 482/147

* cited by examiner

*Primary Examiner*—Stephen R. Crow
(74) *Attorney, Agent, or Firm*—A & J

(57) ABSTRACT

A body contouring device comprising a base seat, a powered disc, a protective board, a pedal seat and a plurality of steel balls is disclosed. The lower section of the base seat is provided with a plurality of spaced apart supportive board evenly distributed below the base seat. One end of the lower section of the base seat is provided with a motor holding seat having a motor. Further a recess is provided at the upper section of the base seat and is used for the connection with the protruded top at the lower section of the powered disc. The lower section of the powered disc is provided with an external rail connected to the recessed rail at the upper section of the base seat. The top section of the pedal seat is provided with a plurality of protrusions arranged in a shape of the sole. A plurality of magnetic stones are provided within a magnetic stone slot, and the front section of the base seat is provided with a seat slot mounted with a handrail with a control panel having connected with a signal cable passing through a top hole on the handrail and via a bottom hole to a circuit board. The circuit board is connected to a power source. The control panel provides signals such as time, speed and ON/OFF via the signal cable. The user stands onto the pedal seat and the hands hold the handrail. By pressing the control panel, the rotation of the motor is initiated with respect to speed and time. Based on the rotating of the present structure, the waist and abdomen of the body are rotated with respect to predetermined speed and time and these body parts can thus be slimmed down.

1 Claim, 6 Drawing Sheets

BODY CONTOURING DEVICE

BACKGROUND OF THE INVENTION (a) Technical Field of the Invention

The present invention relates to a body contouring device.

(b) Description of the Prior Art

To most people who wish to slim down their waist or abdomen, they normally visit beauty salon or the like for assistance and advice. However, a large amount of money and time have to spend but the effect of slimming is rather limited and insignificant Some people go jogging and attending swimming courses in order to slim down. But due to poor determination, these forms of exercises will normally fruitless to these people.

As shown in FIG. 1, some people make use of a hula-hoop to slim down the waist or abdomen but the result of such exercise is also very limited.

Therefore, it is an object of the present invention to provide a body contouring device which can provide an effective method of slimming the waist and the abdomen of the body.

SUMMARY OF THE INVENTION

Accordingly, it is an object of the present invention to provide a body contouring device comprising a base seat, a powered disc, a protective board, a pedal seat and a plurality of steel balls, characterized in that the lower section of the base seat is provided with a plurality of spaced apart supportive boards evenly distributed below the base seat to support pressure from the above, a plurality of protruded posts are further provided at the lower section of the base seat for the fastening with screws after combination with the base seat, one end of the lower section of the base seat is provided with a motor holding seat having a motor, further, a recess is provided at the upper section of the base seat and is used for the connection with the protruded top at the lower section of the powered disc, the lower section of the powered disc is provided with an external rail connected to the recessed rail at the upper section of the base seat, and the diameter of the powered disc is slightly smaller than that between the recessed rail and the recess, the inner side of the inner rail at the lower section of the powered disc is provided with inter-linked gears connected to the gears of the main shaft of the motor for rotating power, a plurality of slots are provided between the recessed rail and the recess, the slot is provided with a protective cover having a steel ball, the upper section of the powered disc is provided with the protective board connected to the pedal seat, the lower section of the pedal seat is provided with a plurality of slots having a protective cover with a steel ball therein, the lower section of the pedal seat is provided with a top bearing slot having a top bearing, linking shaft is connected to the pedal seat and is mounted with a bottom bearing the bottom bearing slot at the bottom seat, thereby the movement of the pedal seat is smooth.

Yet another object of the present invention is to provide a body contouring device, wherein the device provides slimming exercises, and an effective slimming result can be attained.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
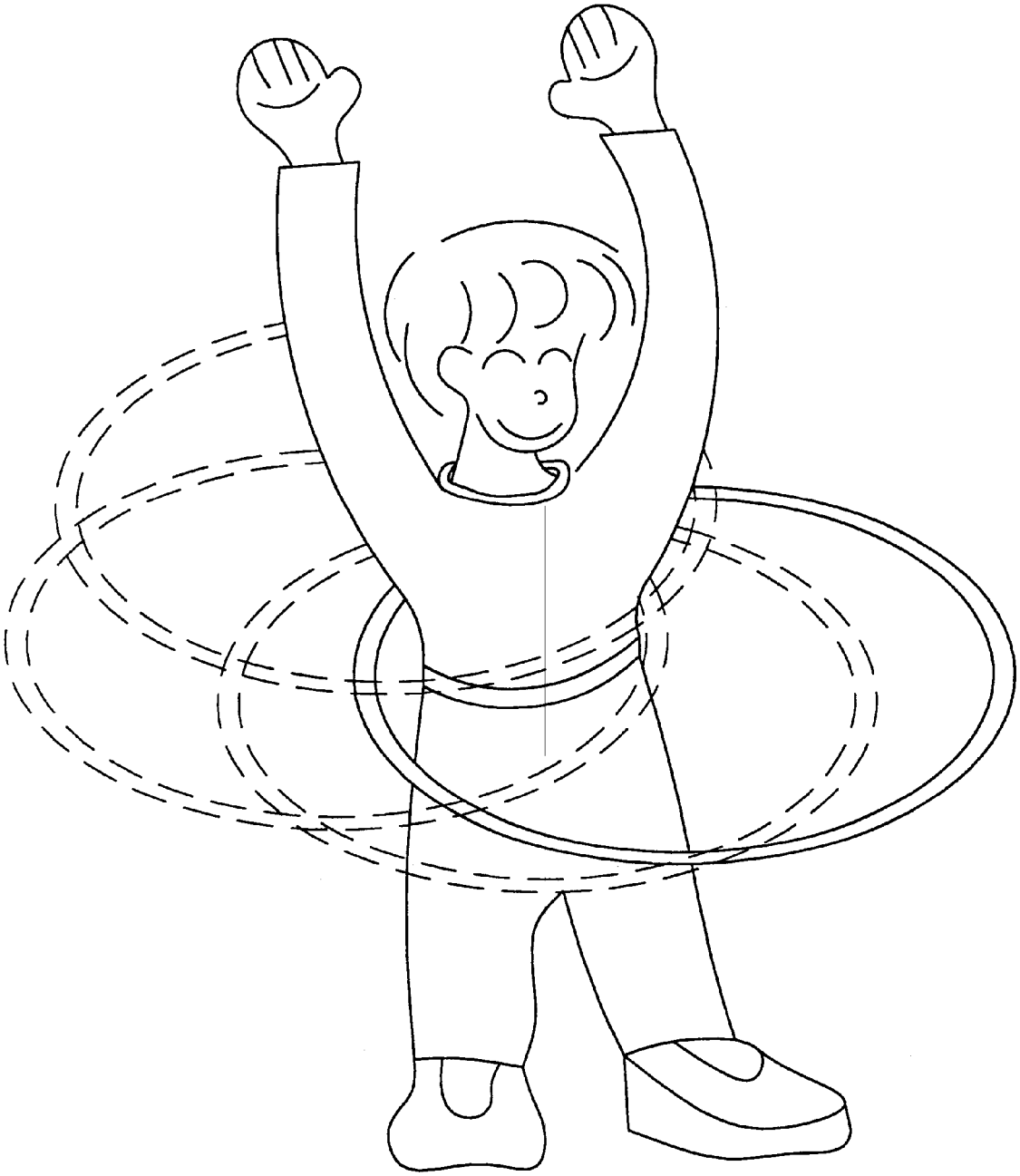
PRIOR ART FIG. 1
FIG. 1 is a schematic view showing a way of slimming exercise using a hula hoop.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
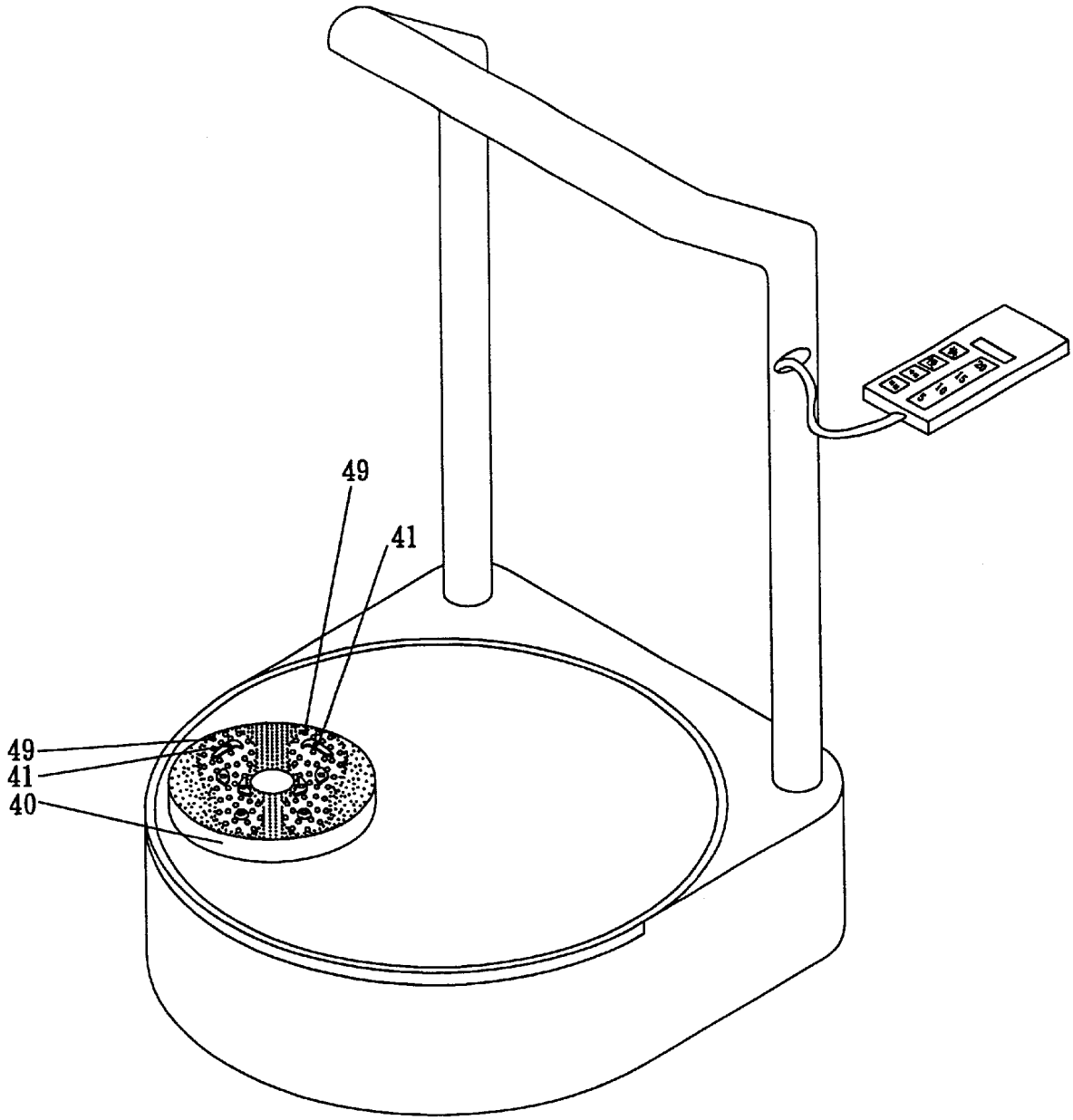
FIG. 2 is a perspective view of a body contouring device in accordance with the present invention.
Figure 3:
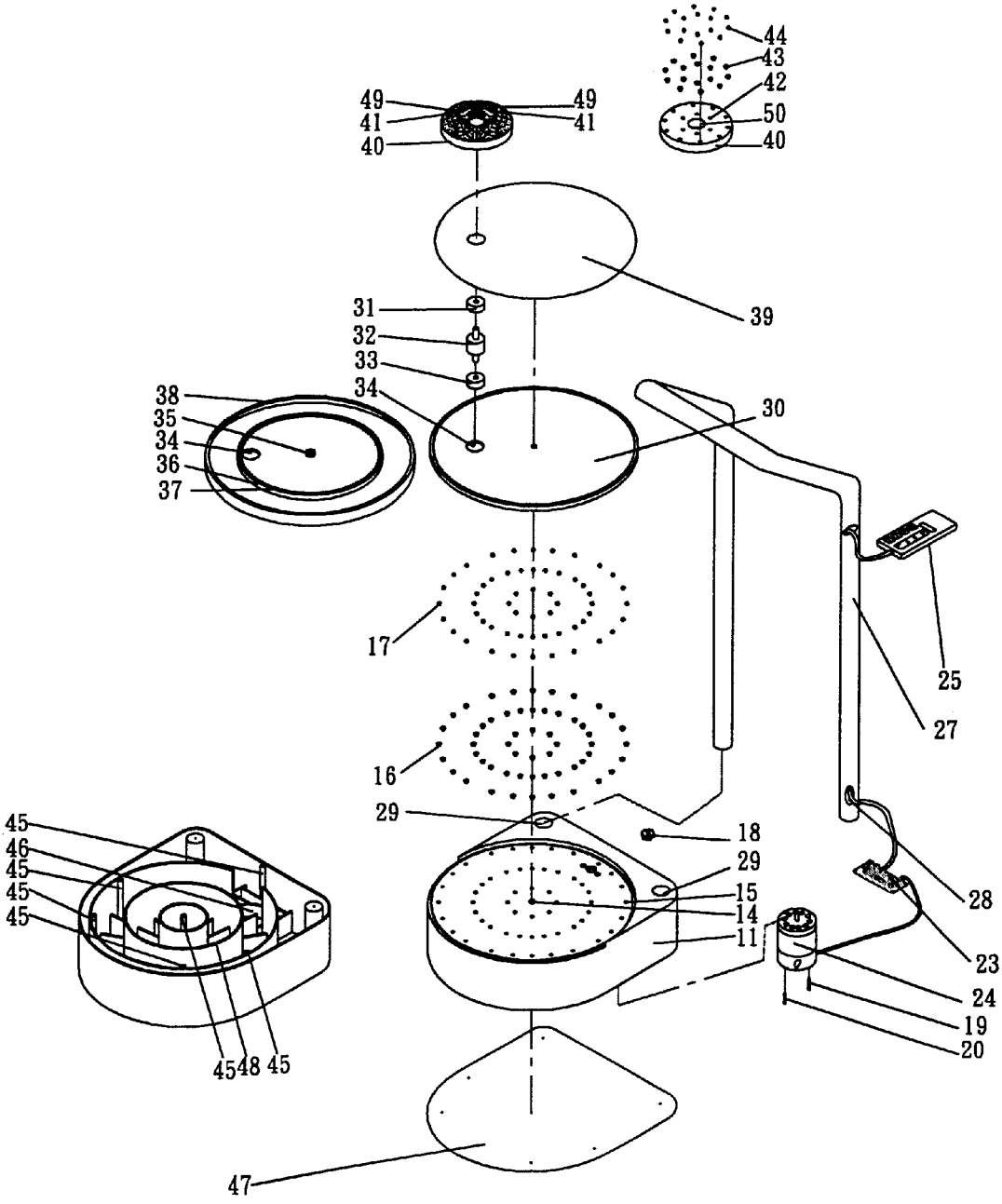
FIG. 3 is a perspective exploded view of the body contouring device in accordance with the present invention.
Figure 4:
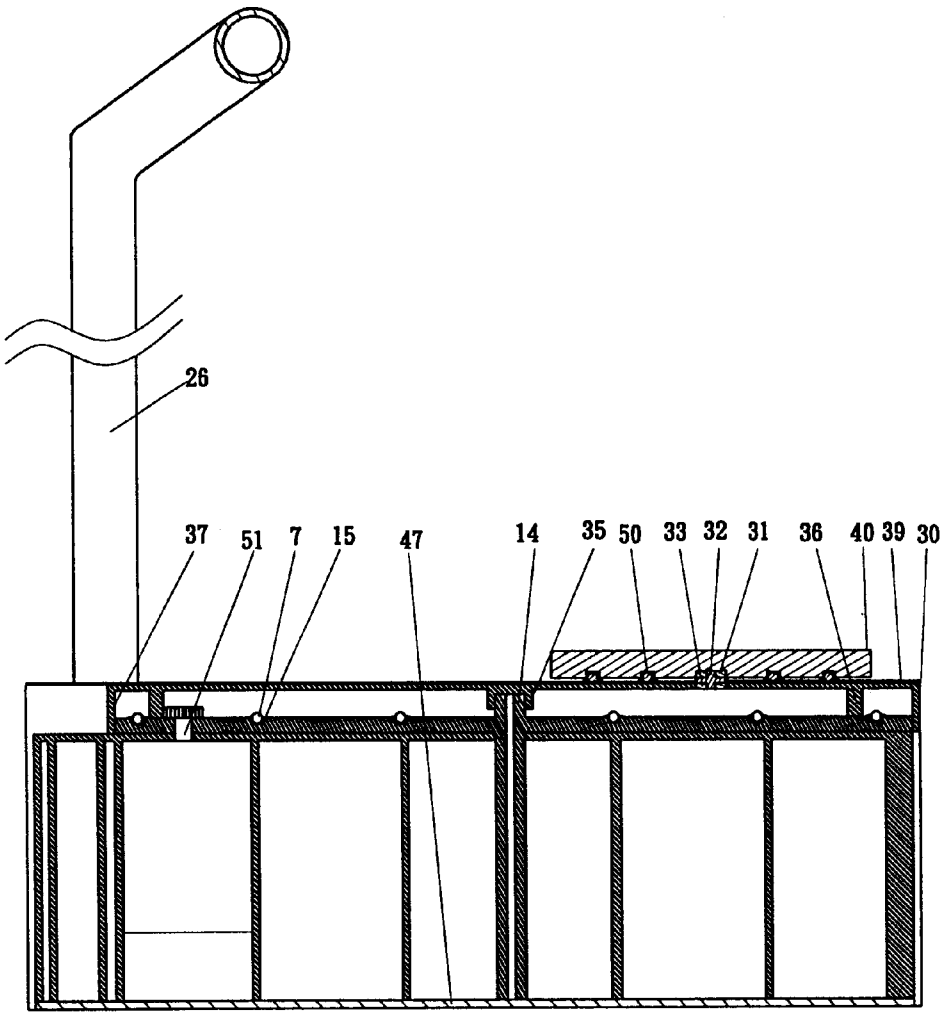
FIG. 4 is a sectional view of the body contouring device of the present invention.

Referring to FIGS. 2 and 3, there is shown a body contouring device comprising a base seat 11, a powered disc 30, a protective board 39, a pedal seat 40 and a plurality of steel balls 17. In accordance with the present invention, the lower section of the base seat 11 is provided with a plurality of spaced apart supportive boards 48 evenly distributed radially into a plurality of layers below the base seat 11 to support pressure from the above. A plurality of protruded posts 45 with center holes are further provided at the lower section of the base seat 45 for the fastening with screws after combination with the base seat 45. One end of the lower section of the base 45 is provided with a motor holding seat 46 having a motor 24.

The motor 24 is secured by means of the screw holes A19, B20 and screw nuts A21, B22, such that the motor 24 produces power to the main shaft 51. Further, a recess 14 is provided at the upper section of the base seat 45 and is used for the connection with the protruded top 35 at the lower section of the powered disc 30. The lower section of the powered disc 30 is provided with an external rail 38 connected to the recessed rail 12 at the upper section of the base seat 45 and the diameter of the powered disc 30 is slightly smaller than that between the recessed rail 12 and the recess 14. The inner side of the inner rail 36 at the lower section of the powered disc 30 is provided with inter-linked gears 307 connected to the gears 18 of the main shaft 51 of the motor 24 to obtain power. A plurality of slots 15 are provided between the recessed rail 12 and the recess 14. The slots 15 are provided with a protective cover 16 having a steel ball 17. The upper section of the powered disc 30 is provided with the protective board 39 connected to the pedal seat 40. The lower section of the pedal seat 40 is provided with a plurality of slots 50 having a protective cover 43 with a steel ball 44 therein. The lower section of the pedal seat 40 is provided with a top bearing slot 42 having a top bearing 31. A linking shaft 32 is connected to the pedal seat 40 and is mounted with a bottom bearing 33 in the bottom bearing slot 34 at the bottom seat 11. Thereby, the movement of the pedal seat 40 is smooth.

Figure 5:
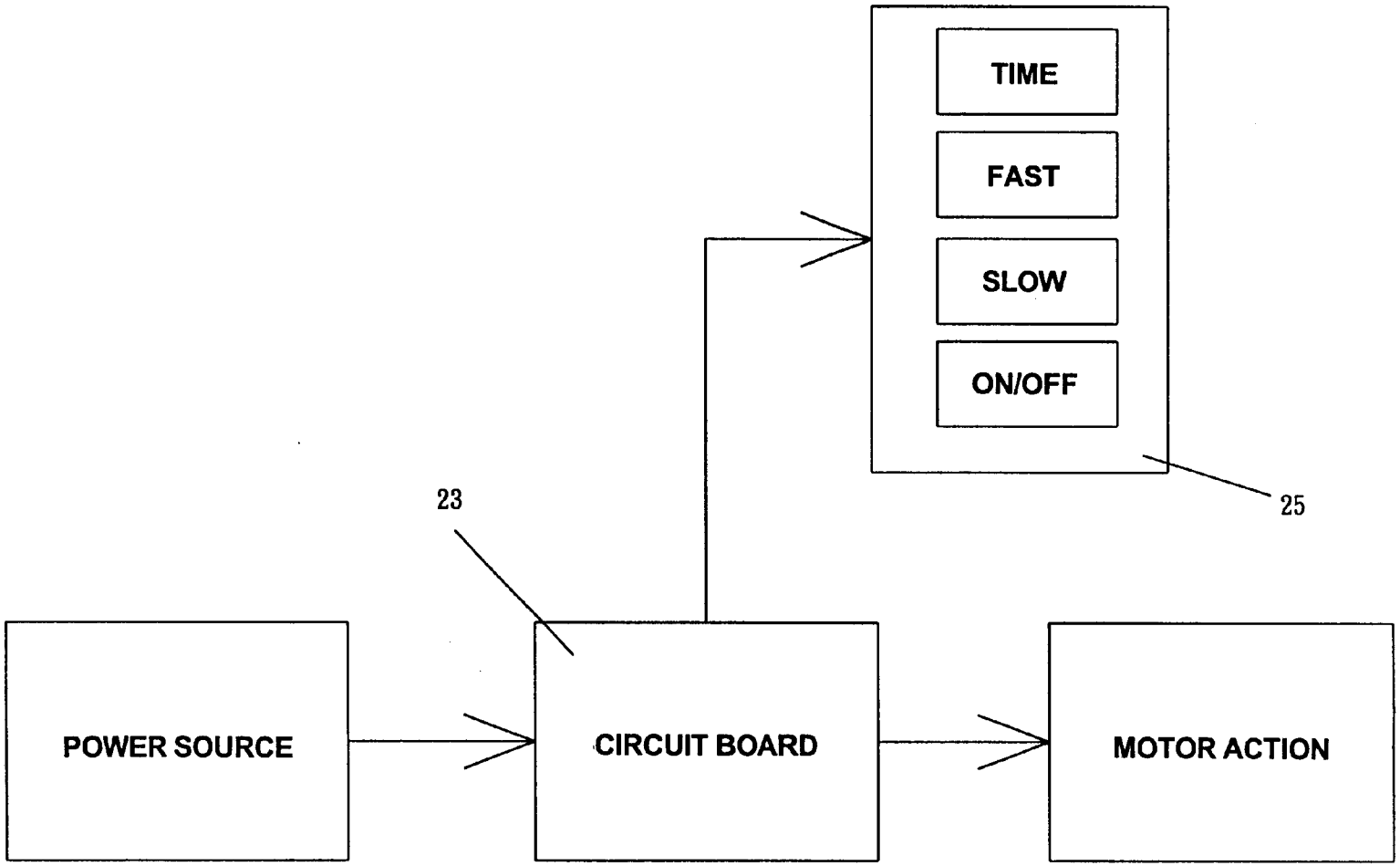
FIG. 5 is a flowchart illustrating the operation of the body contouring device.

The top section of the pedal seat 40 is provided with a plurality of protrusions 49 arranged in a shape of the sole. A plurality of magnetic stones are provided within a magnetic stone slot 41, and the front section of the base seat 11 is provided with a seat slot 29 mounted with a handrail 26 with a control panel 25 having connected with a signal cable passing through a top hole 27 on the handrail 26 and via a bottom hole 28 to a circuit board 23. The circuit board 23 is connected to a power source. The control panel 25 provides signals such as time, speed and ON/OFF via the signal cable (as shown in FIG. 5).

Figure 6:
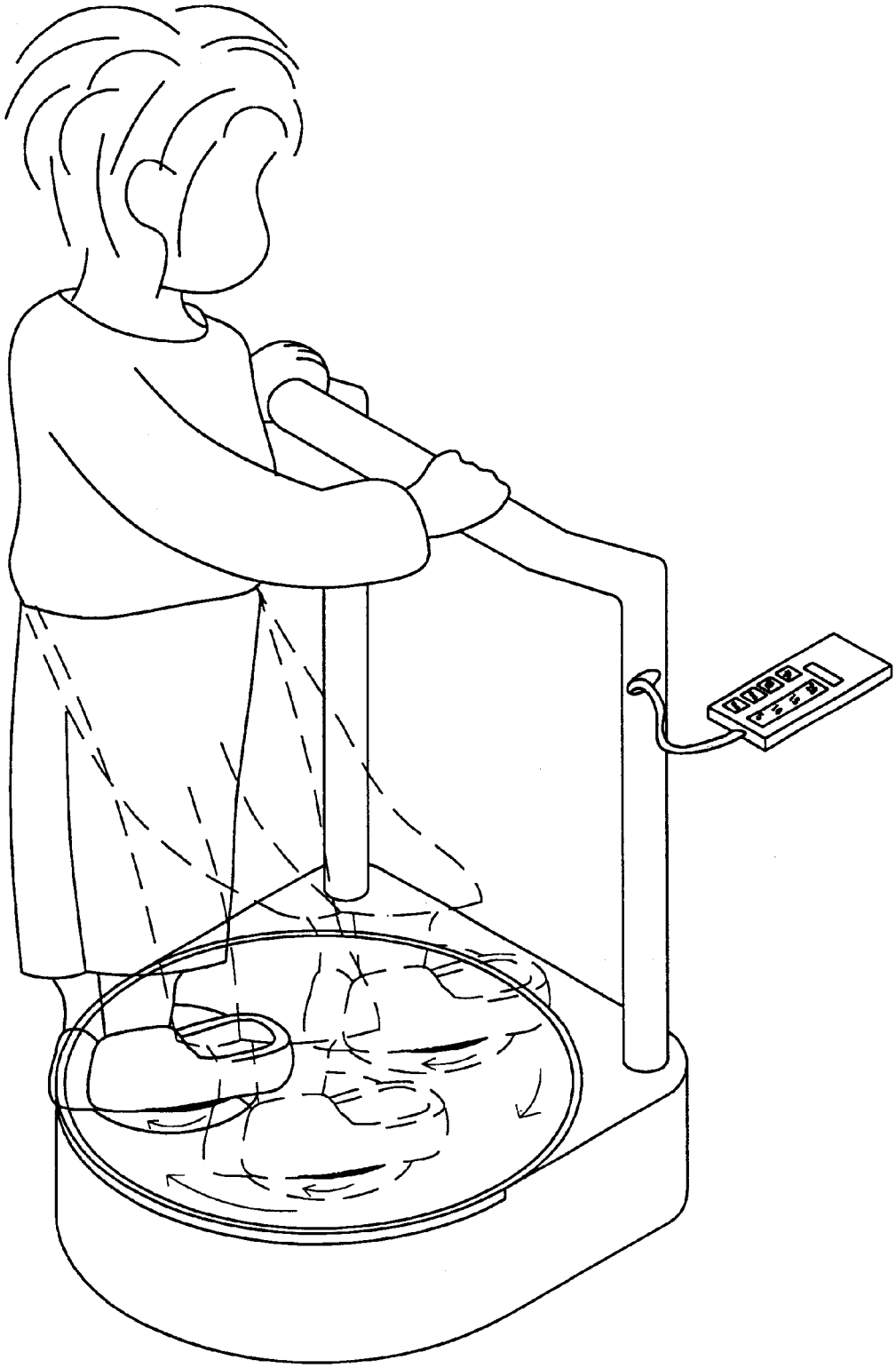
FIG. 6 is a schematic view showing the implementation of the body contouring device in accordance with the present invention.

Referring to FIG. 6, there is shown the user stands onto the pedal seat 40 and the hands hold the handrail 26. By pressing the control panel 25, the rotation of the motor is initiated with respect to speed and time. Based on the rotating of the present structure, the waist and abdomen of the body are rotated with respect to predetermined speed and time and these body parts can thus be slimmed down. In addition, the sole of the legs is massaged as a result of the magnetic stones and the protrusions 49.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A body contouring device comprising a base seat, a powered disc, a protective board, a pedal seat and a plurality of steel balls, wherein a lower section of the base seat is provided with a plurality of spaced apart supportive board evenly distributed below the base seat to support pressure from above, a plurality of protruded posts are further provided at the lower section of the base seat for fastening with screws after combination with the base seat, one end of the lower section of the base seat is provided with a motor holding seat having a motor, a recess is provided at an upper section of the base seat and is used for connection with a protruded top at a lower section of the powered disc, the lower section of the powered disc is provided with an external rail connected to a recessed rail at the upper section of the base seat and a diameter of the powered disc is smaller than that between the recessed rail and the recess, an inner side of the inner rail at the lower section of the powered disc is provided with inter-linked gears connected to gears of a main shaft of a motor to obtain power, a plurality of slots are provided between the recessed rail and the recess, the slot is provided with a protective cover having a steel ball, an upper section of the powered disc is provided at the protective board connected to the pedal seat, a lower section of the pedal seat is provided with a plurality of slots having a protective cover with a steel ball therein, a lower section of the pedal seat is provided with a top bearing slot having a top bearing, a linking shaft is connected to the pedal seat and is mounted with a bottom bearing in a bottom bearing slot at the bottom seat thereby movement of the pedal seat is smooth, a top section of the pedal seat is provided with a plurality of protrusions arranged in shape of a sole, and a plurality of magnetic stones are mounted within a magnetic stone slot, and a front section of the base seat is provided with a seat slot mounted with a handrail, with a control panel having connected with a signal cable passing through a hole on the handrail to a circuit board, the circuit board is connected to a power source, the control panel transmits, speed, ON/OFF signals through a signal cable to initiate rotating action.

* * * * *